United States Patent [19]

Focke

[11] 4,183,191

[45] Jan. 15, 1980

[54] VACUUM HOLDING APPARATUS FOR WRAPPING CIGARETTE PACKS IN BLANKS

[75] Inventor: Heinz Focke, Verden, Fed. Rep. of Germany

[73] Assignee: Focke & Co., Verden, Fed. Rep. of Germany

[21] Appl. No.: 939,938

[22] Filed: Sep. 6, 1978

[30] Foreign Application Priority Data

Sep. 7, 1977 [DE] Fed. Rep. of Germany ..... 2740266

[51] Int. Cl.[2] ..... B65B 11/28

[52] U.S. Cl. ..... 53/225; 53/222; 53/234

[56] References Cited

U.S. PATENT DOCUMENTS

| | | | |
|---|---|---|---|
| 1,984,850 | 12/1934 | Van Buren | 53/225 |
| 3,735,767 | 5/1973 | Kruse et al. | 53/563 X |
| 3,877,354 | 4/1975 | Schmermund | 53/234 X |
| 4,085,568 | 4/1978 | Focke et al. | 53/234 |

*Primary Examiner*—John Sipos

*Attorney, Agent, or Firm*—Sughrue, Rothwell, Mion, Zinn and Macpeak

[57] ABSTRACT

A cigarette pack 10 is pushed against a transversely held blank 11 of cellophane or polyethylene whereby the blank forms a U-shaped wrapping around the pack with outwardly extending end flaps 12, 13, 14 and side flaps 15, 16, and is thereafter inserted into a radial pocket 19 of an indexing turret 20. When the bottom side flap 16 is folded against the side of the pack by finger 23, it is held in position by its end flaps 14 engaging the end faces 27, 28 of folding cams 25, 26 through which vacuum pressure is applied. The suction is maintained until the top side flap 15 is subsequently folded over the pack by a guide member 24 and sealed to the flap 16 along a joint 17. The cams also serve to fold the flaps 12 against the ends of the pack as it is being inserted into the pocket.

6 Claims, 3 Drawing Figures

VACUUM HOLDING APPARATUS FOR WRAPPING CIGARETTE PACKS IN BLANKS

BACKGROUND OF THE INVENTION

This invention relates to an apparatus for wrapping cigarette packs in an outer blank of cellophane or polyethylene. As the pack is inserted into a radial turret pocket the blank is folded around it in a U-shape with laterally projecting end and side flaps. The side flaps are successively folded against the pack and sealed together in an overlapping manner to form a tubular casing.

Tubular casings of this kind are frequently formed in packaging as an intermediate fold configuration for a blank. The blank is held in readiness in a preferably vertical plane, through which the pack is conveyed, the blank being folded in the form of a U-shape around the pack in conjunction with a turret pocket, a mouthpiece or the like. In this condition the tubular casing flaps initially project rearwardly over the pack. The blank is so dimensioned that laterally projecting end flaps are also formed. As the packaging operation continues, the tubular casing flaps are first folded against the pack and sealed together in the region of their overlap. The laterally projecting end flaps are then folded against the ends of the pack and sealed.

It is already known so to construct the pockets of a turret or the like that folding cams forming the lateral boundaries of the pocket fold the projecting end flaps of the blank against the pack when the latter is inserted into the pocket.

SUMMARY OF THE INVENTION

An object of this invention is to further develop and improve apparatuses of this type so that cleanly wrapped packs can be produced at an increased rate with relatively little expenditure, by appropriately holding a folded flap of the blank in position during the subsequent phases of the folding operation.

To this end, the apparatus according to the invention is characterised in that end flaps projecting laterally beyond the pack and associated at least with the first tubular casing flap to be folded, are held in their folded position against the packs by lateral suction holders, during part of the remainder of the folding operation until the two tubular casing flaps are sealed together.

The invention is based on the finding that it is particularly difficult to precisely and accurately form the tubular casing fold, i.e. the intermediate fold configuration of the blank. The projecting tubular casing flaps have to be successively folded to provide an exact and consistent degree of overlap, and the first folded flap connot be temporarily held in a precise position because the folding means that are conventionally used for this operation are mounted in a fixed location and do not move with the pack. Thus, according to this invention the tubular casing flap which is the first to be folded is held in its folded position by the engagement of its laterally projecting end portions. The flap is preferably so held unitl both of the tubular casing flaps have been overlapped and sealed together.

According to a further aspect of this invention, the lateral suction holders of the pockets are formed by folding cams, which are known per se and which define the sides of the pockets. The folding cams thus carry out a dual function; when the pack with the blank is inserted into the pocket the laterally projecting end flaps at the front are folded and after a tubular casing flap has been folded against the pack it is held at the end faces of the folding cams.

DETAILED DESCRIPTION OF THE PREFERRED EMBODIMENT

Figure 1:
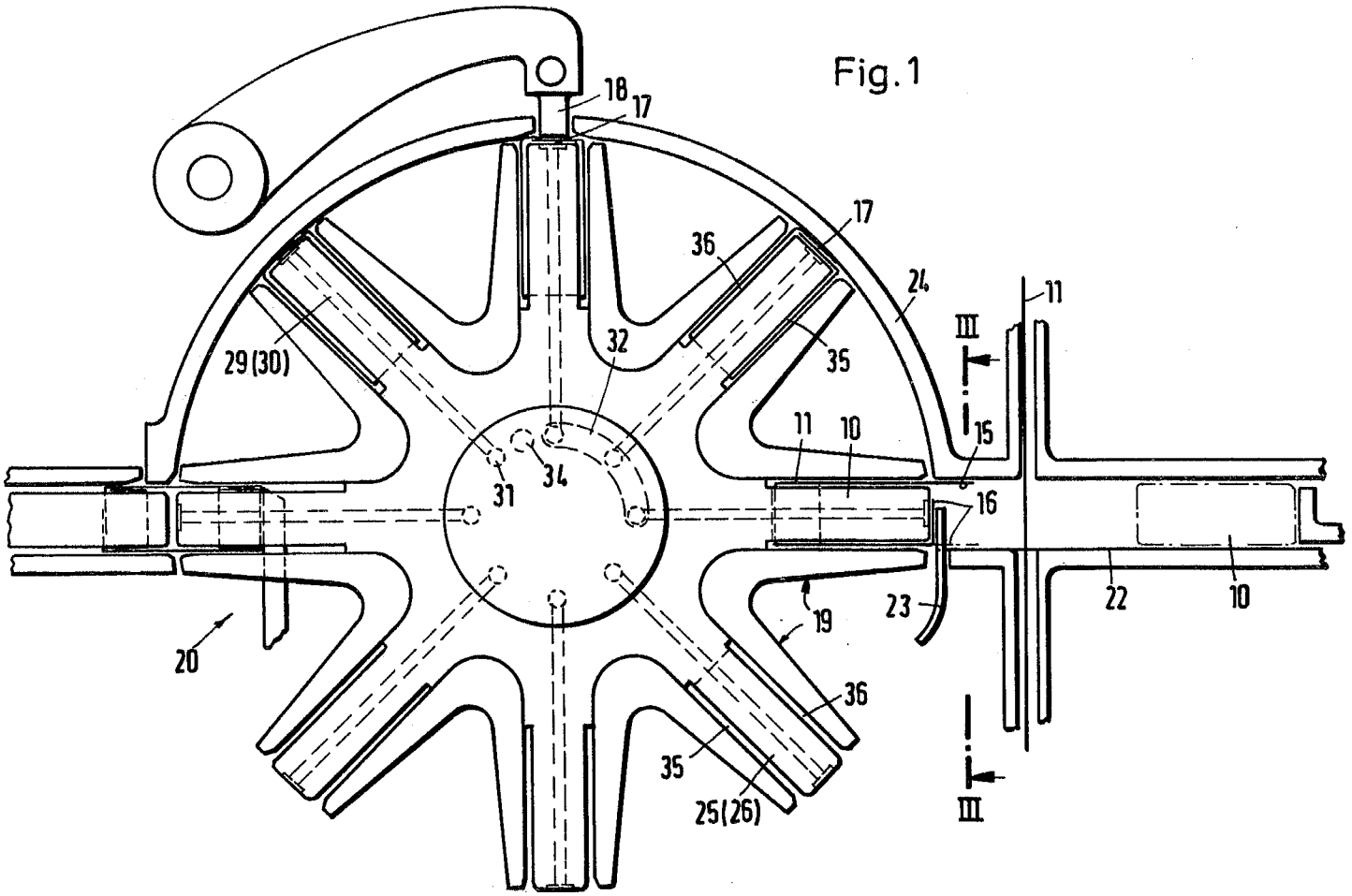
FIG. 1 is a diagrammatic side elevation of a turret according to the invention having a plurality of pockets.

The drawings show the wrapping of block-shaped cigarette packs 10 in outer blanks 11. Conventional cigarette packs are usually wrapped in an outer blank of cellophane. Attempts to use other materials, e.g. polyethylene sheeting, for this outer wrapping have hitherto encountered difficulties in processing, which are largely overcome by the present invention.

During a first phase the blank 11 is folded in the form of a U around the cigarette pack 10. The blank is dimensioned to form laterally projecting end flaps including a front end flap 12, top and bottom middle end flaps 13 and top and bottom tubular casing end flaps 14, in addition to tubular casing flaps 15 and 16 which project rearwardly over the cigarette pack 10.

During the continuation of the folding process the blank 11 is first folded to form a tubular casing structure by the overlap folding of the tubular casing flaps 15 and 16 on the facing side of the cigarette pack 10 at a joint 17. The flaps 15 and 16 are then sealed in the region of joint 17 by a pivotally mounted welding tool 18 or the like. The laterally projecting end flaps which remain are subsequently folded over in a known manner.

Figure 2:
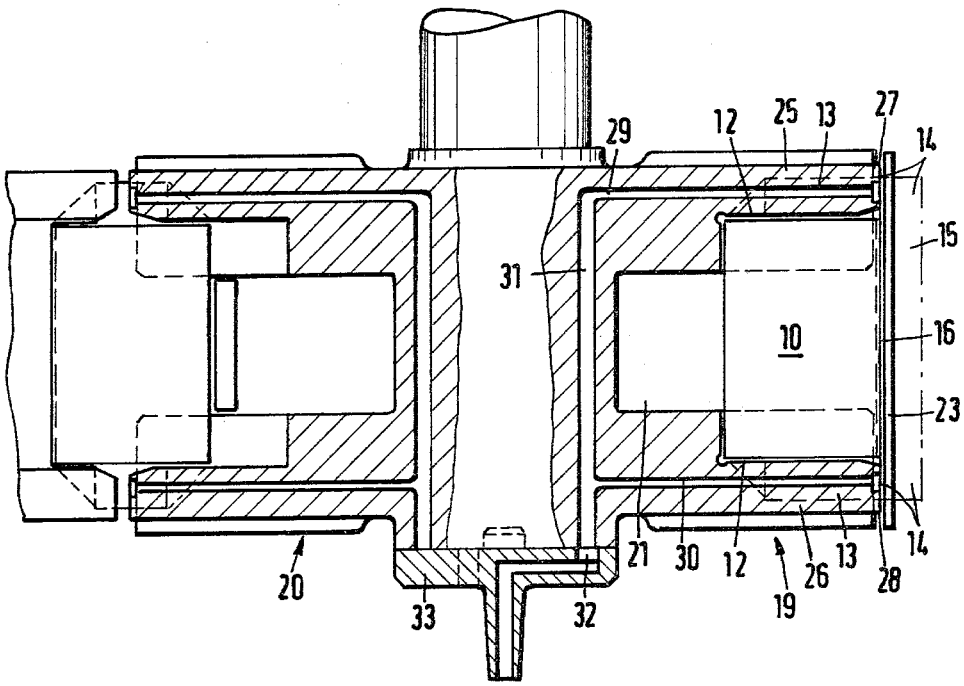
FIG. 2 is a radial section through the turret of FIG. 1.
Figure 3:
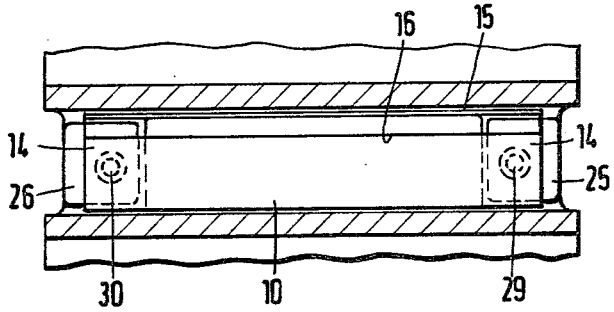
FIG. 3 is a partial section and end elevation of a turret pocket in an enlarged scale, taken on lines III—III in FIG. 1.

To perform the folding operations described the cigarette pack 10 and blank 11 are accommodated in a partially surrounding holding pocket 19. In the embodiment shown a plurality of eight radially extending pockets 19 are combined to form a turret 20. The pockets 19 are open on their radially outer sides to receive the cigarette packs 10 and blanks 11. The turret 20, as shown in FIG. 2, is also provided with an annular central recess 21 in order to reduce weight and save material. The pockets 19 are thus, in one sense, each formed as two spaced recesses to accommodate the respective end portions of the cigarette pack 10.

The cigarette packs 10 are fed to the turret 20 along a radial track 22. The blank 11 is held in readiness transversely of and near the track 22. The conveyance of the pack 10 relative to the blank 11 causes the latter to be wrapped around the pack in the form of a U. In this relative arrangement the pack 10 and the blank 11 are inserted into an aligned pocket 19 of the turret 20 adjoining the track 22.

The dimensions are so selected that the inserted cigarette pack 10 is substantially flush with the radially outer limit of the pocket 19. The tubular casing flaps 15 and 16 thus initially project from the turret, as seen in FIG. 1.

To form the tubular casing from the blank 11 the bottom flap 16 is first folded against the free outer side of the cigarette pack 10 by a finger 23 which is movable in a vertical plane tangent to the turret 20, after which the finger returns to its bottom or starting position. The rotational indexing of the turret carries the top flap 15 into the region of a fixed guide member 24 which externally surrounds the turret in the form of an arc. The entry of the pocket 19 into the region of the guide member thus causes the flap 15 to be folded over the outer side of the pack against the already folded flap 16. The flaps 15 and 16 are held in this overlapping position by the guide member until they are subsequently sealed together.

According to the invention, means are provided to hold the up-folded bottom flap 16 in position against the outer side of the pack 10 until the top flap 15 is subsequently folded down and the two flaps are sealed together at the joint 17. To this end, the pockets 19 are each provided with lateral folding cams 25, 26 which radially extend into the outer edge region of the pockets and project outwards slightly beyond the circumferential limits thereof. These cams 25, 26 serve to first hold the front end flaps 12 against the end faces of the cigarette pack 10 when the pack with the blank 11 is inserted into the pocket 19 (see FIG. 2). The cams 25 and 26 also have internal suction passages 29 and 30 leading to and terminating at their end faces 27 and 28. Because of the arrangement and configuration of the cams, the end flaps 14 of the blank bear against the end faces 27, 28 of the cams when the bottom flap 16 is folded against the cigarette pack 10. When the vacuum is applied to the suction passages 29, 30 the flap 16 is thus held in the required folding position by the suction of its end flaps 14 against the cam end faces 27, 28.

In the embodiment illustrated, the radially extending suction passages 29 and 30 each lead to a connecting passage 31 extending parallel to the turret axis. At an appropriate angular or rotational position, line 31 communicates with an arc-shaped duct 32 defined in a fixed junction member 33. A vacuum line is in turn connected to the member 33.

As may be seen from FIG. 1 the suction passages 29 and 30 are connected to the duct 32 and hence to the vacuum source during three stations of the turret indexing. At the third station the flaps 15 and 16 are sealed together, so that the suction may then be released via a bleed hole 34 as the turret is further indexed.

Because of their dual folding and suction functions, the cams 25, 26 are constructed as outwardly extending brackets on each side of the pockets 19. Narrow longitudinal slots 35 and 36 are formed between these brackets and the walls of the pockets 19 to accommodate the middle end flaps 13 as each pack and blank is inserted into its pocket.

What is claimed is:

1. An apparatus for wrapping a cigarette pack in a blank, comprising:

(a) a pocket having lateral boundry means whose end faces facing an entry side of the pocket embody vacuum suction means, (b) means for pushing a cigarette pack against a blank disposed in front of the pocket and then into the pocket such that the blank is folded around the pack in a U-shaped manner with tubular casing flaps which extend rearwardly over the pack and which have laterally projecting end flaps, (c) means for folding a first one of said projecting tubular casing flaps against a side of the pack, (d) means for folding a second one of said projecting tubular casing flaps against said side of the pack in such a manner that it overlaps with the first folded flap, and (e) means for sealing the first and second folded flaps together, (f) said vacuum suction means engaging the laterally projecting end flaps of said first tubular casing flap to hold said first tubular casing flap in its folded position until the second tubular casing flap is folded thereover and sealed thereto.

2. Apparatus according to claim 1, wherein said lateral boundry means are defined by folding cams.

3. Apparatus according to claim 2, wherein a plurality of pockets are disposed on an indexable turret, the vacuum suction means comprising suction holes extending radially through the folding cams and being coupled to a vacuum source via a connecting line extending parallel to the turret axis.

4. Apparatus according to claims 2 or 3, wherein the folding cams extend radially beyond the other boundaries of the pocket.

5. Apparatus according to claim 3, wherein the first tubular casing flap is folded against the side of the pack by a folding finger which is adapted to move in a reciprocating manner tangent to the turret.

6. Apparatus according to claim 3, wherein the first tubular casing flap is held by the folding cams during a plurality of turret indexings and until a welding tool station is reached for sealing the tubular casing flaps together.

* * * * *